US007294036B2

(12) United States Patent
Potts

(10) Patent No.: US 7,294,036 B2
(45) Date of Patent: Nov. 13, 2007

(54) FLYING DISC

(76) Inventor: Jonathan Potts, Chegwema, 4B Dunkeld Road, Talbot Woods, Bournemouth, Dorset BN3 7EN (GB)

( * ) Notice: Subject to any disclaimer, the term of this patent is extended or adjusted under 35 U.S.C. 154(b) by 256 days.

(21) Appl. No.: 11/056,509

(22) Filed: Feb. 11, 2005

(65) Prior Publication Data

US 2005/0197037 A1 Sep. 8, 2005

Related U.S. Application Data

(60) Provisional application No. 60/553,425, filed on Mar. 15, 2004.

(30) Foreign Application Priority Data

Feb. 11, 2004 (GB) ..... 0402910.4

(51) Int. Cl.
*A63H 27/00* (2006.01)
*A63B 65/10* (2006.01)
*B64C 15/00* (2006.01)

(52) U.S. Cl. ..... 446/46; 446/48; 473/588; 244/12.2; 244/23 C; 244/34 A; 244/39

(58) Field of Classification Search ..... 446/46–48; 473/588; 244/12.2, 23 C, 34 A, 39
See application file for complete search history.

(56) References Cited

U.S. PATENT DOCUMENTS

| | | | | |
|---|---|---|---|---|
| 3,724,122 | A | 4/1973 | Gillespie, Sr. | |
| 4,205,484 | A * | 6/1980 | Kovac et al. | 446/46 |
| 4,334,385 | A * | 6/1982 | Melin et al. | 446/46 |
| 4,456,265 | A * | 6/1984 | Adler | 473/589 |
| 4,560,358 | A * | 12/1985 | Adler | 446/46 |
| 4,568,297 | A | 2/1986 | Dunipace | |
| 4,669,996 | A * | 6/1987 | Bershak | 446/48 |
| 5,078,637 | A * | 1/1992 | McFarland | 446/46 |
| 5,531,624 | A * | 7/1996 | Dunipace | 446/46 |
| 6,135,455 | A * | 10/2000 | McNally | 273/338 |
| 6,179,737 | B1 * | 1/2001 | Adler | 473/588 |
| 6,247,989 | B1 * | 6/2001 | Neff | 446/46 |
| 6,383,052 | B1 * | 5/2002 | McCarthy | 446/153 |
| 2002/0025755 | A1 * | 2/2002 | McCarthy | 446/153 |
| 2003/0045200 | A1 * | 3/2003 | Tarng et al. | 446/46 |
| 2004/0205807 | A1 * | 10/2004 | Wilcoxson et al. | 720/720 |
| 2005/0070197 | A1 * | 3/2005 | Benson | 446/34 |

FOREIGN PATENT DOCUMENTS

| | | |
|---|---|---|
| WO | WO98/03239 | 1/1998 |
| WO | WO2004/050486 A2 | 6/2004 |

* cited by examiner

*Primary Examiner*—Eugene Kim
*Assistant Examiner*—Urszula M Cegielnik
(74) *Attorney, Agent, or Firm*—Bracewell & Giuliani LLP

(57) ABSTRACT

A circular planform wing includes a contiguous thin central plate having top and bottom surfaces. An outer annular rim encompasses the central plate. The rim has a lower edge defining a lower plane of the wing, and the central plate has an upper zone defining an upper plane of the wing. The rim has a cross-section with a lower rounded corner forming the lower edge, an outer rounded corner, and an upper corner merging with the central plate, the outer corner being located between the upper plane and the lower plane. The rim cross-section has a convex upper curve joining the outer rounded corner to the upper corner, an inside rim surface joining the lower rounded corner to the upper corner, and a convex lower curve joining the outer rounded corner to the lower rounded corner.

24 Claims, 5 Drawing Sheets

FLYING DISC

CROSS-REFERENCE TO RELATED APPLICATION

This application claims the benefit of United Kingdom Patent Application No. 0402910.4, filed on Feb. 11, 2004, and U.S. Provisional Patent Application No. 60/553,425 filed on Mar. 15, 2004.

FIELD OF THE INVENTION

The present invention is concerned with improved circular planform wings, particularly in the form of flying discs.

BACKGROUND OF THE INVENTION

Flying toys which are thrown by a user and rotate to effect an aerodynamically optimised flight are widely used and come in a wide variety of forms, from ring structures such as the Aerobie to the Frisbee. Disc Golf is an increasingly popular sport and the flying discs used to play it are regulated by the PDGA (Professional Disc Golf Association) and manufacturers include Ching, Disc Golf Association, Discraft Inc., Disc Golf Stuff, Dynamic Discs, Gateway Disc Sports, Innova-Champion Discs Inc., Lightning Discs, Millennium Golf Discs, Superflight Inc., and Wham-O.

A typical disc is axially symmetric with an upper surface plate of minimum thickness adjoined to (i.e. contiguous with) a rim of carefully designed depth. In modem flying discs, the mass of the disc is removed to the rim to maximise the angular momentum given to the disc at launch and subsequently reduce the rate at which the disc rolls (and pitches) in flight. The rim and plate together define a cavity beneath the plate that, due to the high pressure difference caused by the trailing edge rim, stabilises the pitching moment and inhibits the gyroscopic roll rate to within acceptable bounds for free-flight.

Flying discs are aerodynamically unstable. However, the spin decouples the pitching moment from the pitch, leaving the angle of attack unaffected. This primarily results in a minimal roll rate (instead of pitch) and therefore the disc remains at a consistent orientation to the oncoming wind throughout each rotation. For a right-handed backhand throw, for example, the roll direction is typically port wing up at launch with transition to starboard wing up towards the end of the flight, generating the widely observed S-shaped flight trajectory. This S-shaped flight path is feasible provided that the disc flies through its zero pitching moment trim condition, i.e. at launch the typically nose down (negative) pitching moment provides roll, bank and curve in the opposite lateral direction to that exhibited late on in the flight when there is a nose up (positive) pitching moment, the initial lateral direction being dependent upon the spin vector.

The flying disc cross-sectional profile is an aerofoil or lifting surface, typically with symmetry about its mid-chord (center) (although some flying discs are made asymmetric, i.e. are not axi-symmetric, with the center of the cavity being offset from the center of the upper surface plate). Aerofoils comprising symmetric sections are uncommon in aeronautical applications when compared to conventional aerofoils which have an asymmetric cross-section comprising a blunt leading edge and sharp trailing edge. An axi-symmetric disc spins about its centroid, which is the location of the center of gravity. Axi-symmetry also provides a disc with consistent aerodynamic characteristics throughout each rotation, due to the consistent geometric orientation of the disc to the oncoming wind.

The aerodynamic performance of a flying disc is primarily dependent upon the lift, drag and pitching moment load characteristics.

Lift is generated by the difference in relative pressure below the wing surface compared with that above the wing surface. The aerodynamic pressure difference creates a lifting force to counteract the force due to gravity and thus retards the loss of altitude. For a flying disc, lift contributions come from the (relatively) large pressure differences found on the nose and tail. The pressure difference on the nose is driven by accelerated air passing over the upper nose surface, which generates a low pressure suction above the nose. The pressure difference on the tail is caused by the presence of the inside rim surface which sets up higher pressure below the tail.

Drag is generated by the force of the air on the disc in the direction opposite to that in which it travels. Primary contributions to the drag are the suction on the nose inside rim and the higher pressure on the tail inside rim. The lower rim surfaces create turbulence beneath the disc, which affects the downwash and induced drag.

Primary contributions to the pitching moment are due to the strength of the two (lifting) pressure differences on the nose and tail. The unbalanced strength of these lifting forces, forward and aft of the center, generate an untrimmed (i.e. non-zero) pitching moment. Nose up (positive) pitching moment occurs when the torque due to the lift on the nose is stronger than the torque due to the lift on the tail. Nose down (negative) pitching moment occurs when the torque due to the lift on the tail is stronger than the torque due to the lift on the nose.

The various manufacturers of golf (flying) discs aim to optimise a range of properties, including flight characteristics, ability to fly, and throwability. Various patents exist for flying discs and include U.S. Pat. Nos. 3,359,678, 4,568,297 and 6,179,737. Design patents also exist and include U.S. Pat. No. 402,318.

In U.S. Pat. No. 4,568,297, a one-piece flying disc is disclosed having a convex upper surface, an annular rim having an equilateral triangle cross-section with a straight lower edge between: (i) a lower rounded corner of the rim forming a lower edge; and (ii) an outer rounded corner. In particular, it seeks to increase the flight efficiency by reducing drag, increasing the lifting area, and redistributing mass towards the rim of the disc.

A wide range of flying discs are commercially available (above) incorporating the features of U.S. Pat. No. 4,568,297, and typically have a convex upper surface and a concave lower surface.

U.S. Pat. No. 6,179,737 discloses flying discs having an outer rim portion encompassing a thin central plate, and whose cross-section from the central plate to the top and bottom edges of the rim comprises concave curves (fillet curves).

Generally speaking, to improve the aerodynamic performance of a flying disc, the aim is to maximise lift, minimise drag and minimise the pitching moment gradient with angle of attack. The improvement of one out of three of these can often incur a performance penalty in one or more of the other two. Therefore, to improve overall aerodynamic performance the lift, drag and pitching moment combination is crucial. Improved performance can be achieved by creating stronger pressure differences (improved lift) particularly on the tail (increased nose down pitching moment) or by further streamlining (improved drag).

SUMMARY OF THE INVENTION

The present invention seeks to improve upon the prior art flying discs, and in particular to further enhance flight efficiency such that a given throw of a disc of the present invention will result in a greater flight distance (range) than the same throw would achieve with a prior art flying disc.

According to a first aspect of the present invention there is provided a circular planform wing having a structure having a contiguous thin central plate having top and bottom surfaces. An outer annular rim encompasses the central plate. The rim has a lower edge defining a lower plane of the wing, and the central plate has an upper zone defining an upper plane of the wing. The rim has a cross-section with a lower corner forming the lower edge, an outer rounded corner, and an upper corner merging with the central plate. The outer corner is located between the upper plane and the lower plane. The rim cross-section has a convex curve joining the outer rounded corner to the upper corner. An inside rim joins the lower corner to the upper corner, and the lower corner comprises a curve from a first point comprising the lower edge to a second point where the lower corner merges with the inside rim. The radius of curvature of the curve decreases from the first point to the second point.

The rim cross-section can be a part of a cross-section through the center of the wing.

The lower plane is defined by the lowest point on the wing (i.e. with the top of the central plate defining the highest point on the wing), and this point at which the lower plane intersects the wing (i.e. intersects the rim) can be the point at which the lower edge terminates and the lower corner starts, and particularly can be the first point of the lower corner.

The curve from the first point to the second point can be a section of a conic section, for example a section of an ellipse between a minor axis adjacent the lower edge and a major axis. However, the curve can alternatively be approximately elliptical, or another conic section, or an approximation to another conic section. In particular, the curve from the first point to the second point by virtue of its decreasing radius of curvature is therefore not an arc of a circle.

The radius of curvature of the curve decreasing from the first point to the second point can also be referred to by way of the rate of change of the angle of a tangent to the curve when travelling from the first point to the second point being non-zero, particularly by it being greater than zero.

Alternatively, with the curve from the first point to the second point being a section of a conic section (or an approximation of one), it can be described with reference to the semi-latus rectum i.e. the distance from a focus of the conic section to the conic section itself, measured along a line perpendicular to the major axis. Thus the semi-latus rectum can decrease from the first point to the second point. In particular, at the second point the semi-latus rectum can be less than 95%, 90%, 85%, 80%, 75%, 70%, 65%, 60%, 55%, 50%, 45%, 40%, 35%, 30%, 25%, 20%, 15%, 10%, or 5% of the semi-latus rectum at the first point.

With regard to the decrease in the radius of curvature from the first point to the second point, the radius of curvature at the second point may be less than 95%, 90%, 85%, 80%, 75%, 70%, 65%, 60%, 55%, 50%, 45%, 40%, 35%, 30%, 25%, 20%, 15%, 10%, or 5%, of the radius of curvature at the first point.

Similarly, the curve from the first point to the second point need not be an exact section of an ellipse adjacent the lower edge and a major axis, but instead can approximate such a curve.

The rim cross-section can have a convex curve joining the outer rounded corner to the lower corner.

Also provided according to a second aspect of the present invention is a circular planform wing having a structure comprising a contiguous thin central plate having top and bottom surfaces. An outer annular rim encompasses the central plate. The rim has a lower edge defining a lower plane of the wing, and the central plate has an upper zone defining an upper plane of the wing. The rim has a cross-section with a lower rounded corner forming the lower edge, an outer rounded corner, and an upper corner merging with the central plate. The outer corner is located between the upper plane and the lower plane. The rim cross-section has a convex curve joining the outer rounded corner to the upper corner, an inside rim joining the lower rounded corner to the upper corner, and a convex curve joining the outer rounded corner to the lower rounded corner.

In the various embodiments of the invention, the rim cross-section can have a continuous convex curve joining the outer rounded corner and the upper corner, and a continuous convex curve joining the outer rounded corner to the lower corner. Thus, the sections of the rim joining the outer rounded corner to the upper corner and to the lower corner can consist only of curved sections, for example a single continuous curve, or a combination of curved sections, such as arcs and curves, defining an overall continuous convex curve. Excluded from such a continuous convex curve is a straight section.

The radially outermost point of the outer rounded corner can be vertically located 25-65% of the distance from the lower plane to a rim intersection plane at which the central plate bottom surface intersects the inside rim. For example, it can be 30-60%, 35-55%, 40-50%, about 45%, or 45.77% of the distance from the lower plane to the rim intersection plane.

Alternatively, the radially outermost point of the outer rounded corner can be vertically located 25-40% of the distance from the lower plane to the upper plane. For example, it can be 27.5%-37.5%, 30-35%, about 31.5%, or 31.46% of the distance from the lower plane to the upper plane.

The above locating of the radially outermost point of the outer rounded corner is particularly applicable to the wings of the present invention having a lower rounded corner, although it can also apply to embodiments of the invention where the lower corner decreases in radius from a first point to a second point.

The inside rim can be substantially vertical. In particular, the inside rim can be vertical, and so the second point at which the curve merges with the inside rim is the point at which the curve is at zero degrees to the vertical. However, it is possible that it may be desirable to have the inside rim at a non-vertical, for example between +5 and −5 degrees to the vertical. Even if the inside rim is outwardly inclined as it extends towards the central plate, it is still possible to successfully mould it and remove it from a mould, since the disc is flexible and this flexibility will be enhanced whilst the disc is still warm immediately following moulding. These shapes of the lower corner in cross-section are distinct from the prior art flying disc devices which require the use of a "lower rounded corner" i.e. a section of a circle.

The lower edge in the rim cross-section is at an angle of zero degrees to the horizontal.

The wing of the second aspect can have a rim cross-section having a convex curve joining the outer rounded corner to the lower corner.

The wings of the present invention can also be provided with a smooth curvature from the leading edge of the wing (i.e. the outer rounded corner) through the edge defined between the outer rounded corner and the lower corner to the edge defined between the lower corner and the upper corner.

A cross-section of the rim (extending radially from the center of the central plate) can be convex and have a generally triangular shape, for example an equilateral triangle, although the rounded nature of corners and any convex curve formed between corners will of course distort such geometry, and the shape of the cross-section per se is not triangular.

The outer rounded corner is located between the upper plane and the lower plane, the upper plane being defined by an upper zone of the central plate. In particular, the upper plane can be defined by an upper edge of the upper corner.

The lower corner, either in its rounded configuration or its elliptical section configuration is generally referred to herein as a convex lower lip.

Thus the wings of the present invention in particular provide two advantages over the prior art—firstly, the convexly curved section joining the outer rounded corner to the lower corner; and secondly, the provision of an elliptical section (for example an approximate quarter ellipse) which curves gently from the lower corner and then more steeply to a vertical extending towards the upper corner (i.e. it can be a section of an ellipse between a minor axis and a major axis, the minor axis being located adjacent the lower corner, and the major axis being located away from the lower corner, towards the upper corner).

The elliptical section is neither suggested nor disclosed by the prior art, which uses a "rounded corner" for the lower corner of rim sections. It would be possible to increase the radius of curvature of prior art rounded corners, but that can result in undesirable effects including increased cross-sectional area of the rim i.e. increased volume and mass. Alternatively, it is possible to decrease the radius of curvature of prior art rounded corners, but (as detailed below) it is found that doing so will result in an increase in rim height (the height of the generally vertical section joining the lower corner to the upper corner/central plate), which can have undesirable aerodynamic effects.

The circular planform wing can be a flying disc, for example a sports disc. However, the wing of the present invention is useful in other applications—circular planform wings are becoming increasingly popular since their geometry provides for substantial in-flight stability and allows them to fly at a low ground speed whilst still generating positive lift.

The circular planform wing can be made of a single piece.

The circular planform wing can be axi-symmetric about the center of the central plate. In other embodiments, the circular planform wing is not axi-symmetric about the center of the central plate. As discussed below, this can be used to give desired aerodynamic and flight characteristics to the wing.

The present inventor has found that in particular the provision of the convex curve joining the outer rounded corner to the lower rounded corner provides substantial aerodynamic benefits. Similarly, the lower corner decreasing in its radius of curvature towards the inside rim, particularly where its shape is a section of an ellipse, is also extremely aerodynamically beneficial. Neither this structural feature nor the elliptical curve of the lower corner is either suggested or disclosed by the prior art, particularly U.S. Pat. No. 4,568,297.

The wings of the present invention provide a number of advantages which improve their aerodynamics as compared to those of prior art discs and wings. In particular, it seeks to provide enhancement in terms of: (i) nose-down pitching moment; (ii) lift redistribution; and (iii) drag reduction.

Nose-Down Pitching Moment:

The present inventor has found that the strongly curved convex lower lip (i.e. the lower corner, particularly the elliptical section) provides a nose down pitching moment increment, which delays the onset of large destabilising (gyroscopic) roll rate and thus increases stability in flight, as compared to the prior art.

On the leading edge, the elliptical section of the convex lower lip (particularly the elliptical section) causes lower pressure than on comparable prior art discs and wings, producing a (desirable) nose down pitching moment increment.

On the trailing edge rim, the convex lower lip (particularly the elliptical section) enhances boundary layer reattachment of the separated shear layer to the convex curve of the outer rounded corner. The combination of the convex lower lip (particularly the elliptical section) and the convex curve between the outer rounded corner and the lower corner enables the reattached boundary layer to remain attached to the surface through to the trailing edge. This causes the higher pressure maximum on the lower surface trailing edge rim to extend further downstream providing a (desirable) nose down pitching moment increment, as compared to the prior art.

Lift Redistribution:

The convex lower lip (particularly the elliptical section) modifies the pressure distribution to reduce the (pressure) lift on the nose while increasing the lift on the tail. The redistribution of (pressure) lift enhances the nose down pitching moment and therefore improves roll stabilisation, without impairing the overall lift.

Drag Reduction:

Drag reduction cannot be achieved (conventionally) by simply introducing a sharp trailing edge to a circular planform wing as this also creates (undesirable) boundary layer separation on the leading edge. Instead, the convex curve joining the outer rounded corner and the lower corner, together with smooth surface curvature into the convex lower lip, further enhances the aerodynamic and flight characteristics of the wings of the present invention compared to the prior art. The lower half of the trailing edge rim for example takes the approximate shape of a streamlined (conventional) aerofoil i.e. with blunt leading edge (convex lip) and sharp trailing edge.

On the nose: The introduction of the convex lower lip (particularly the elliptical section) reduces the height of the inside rim (i.e. the typically vertically oriented radially inwards section of the rim joining the lower corner to the upper corner), compared to the prior art. This reduction in height of the inside rim (which does not require any reduction in the distance between the upper plane and the lower plane) in turn reduces the inside rim drag contribution as the low pressure suction, present here, now acts on a smaller leading edge inside rim surface. Also, the convex lower reduces the pressure on the lower rim surface further reducing the drag increment contributed by the leading edge rim, as compared to the prior art. In terms of fluid dynamics, with regard to the elliptical section, the initial gentle curve of the convex lower lip from horizontal (convex lower) encourages the boundary layer to stay attached until the steep curve to vertical (inside rim) i.e. separation as close to the rim/center plate juncture as possible.

On the tail: The convex lower lip (particularly the elliptical section) reduces the height of the inside rim, compared to the prior art. This reduces the inside rim drag contribution as the higher pressure, present here, now acts on a smaller trailing edge inside rim surface. Also, the convex lower increases the pressure on the lower rim surface, further reducing the drag increment contributed by the trailing edge rim, as compared to the prior art. In terms of fluid dynamics, the initially steep curve of the convex lip from vertical (inside rim), becoming less steep approaching the horizontal (convex lower), sets up a (positive) pressure gradient favourable to boundary layer reattachment.

Beneath the circular planform wings of the present invention, the improved streamlining and smooth curvature retards the near lower surface flow less than is encountered with comparable prior art wings. In flight, the spillage caused by the inside rim step and the turbulence introduced to the wake is considerably reduced by: (i) the boundary layer separation on the convex lower lip of the leading edge; (ii) the subsequent reattachment and accelerated flow over the convex lower lip of the trailing edge; and (iii) the smooth curvature through convex lower lip to the convexly curved trailing edge. Therefore, the near surface air leaving the trailing edge has greater streamwise velocity than that of comparable prior art wings. This has the desirable effect of reducing the wake downwash angle and the induced drag component, as compared to the prior art.

The wing can be axially symmetric about the center of the central plate. Alternatively, the wing can be asymmetric. For example, the width of the rim (i.e. the radial distance from the lower corner to the outer rounded corner) can vary around the radius of the wing, causing imbalance in the wing and affecting flight characteristics in a desired fashion.

The central plate can be shaped such that in cross-section from the center of the plate to the outer annular rim, the central plate has the same thickness. Alternatively, the thickness of the central plate can vary from the center of the plate to the rim. For example, the central plate can form a shoulder section towards the outer annular rim, the shoulder portion being contiguous with the outer annular rim. The shoulder can increase in thickness from the central plate to the outer annular rim, with the thickness of the shoulder at the outer annular rim approximately twice the thickness of the center of the plate.

BRIEF DESCRIPTION OF THE DRAWINGS

The invention will now be described by way of example with reference to the following figures, in which:

FIG. 5 shows a cross-section through a third disc, corner 63B being defined with reference to a section of an ellipse.

DESCRIPTION OF PREFERRED EMBODIMENTS

Figure 1:
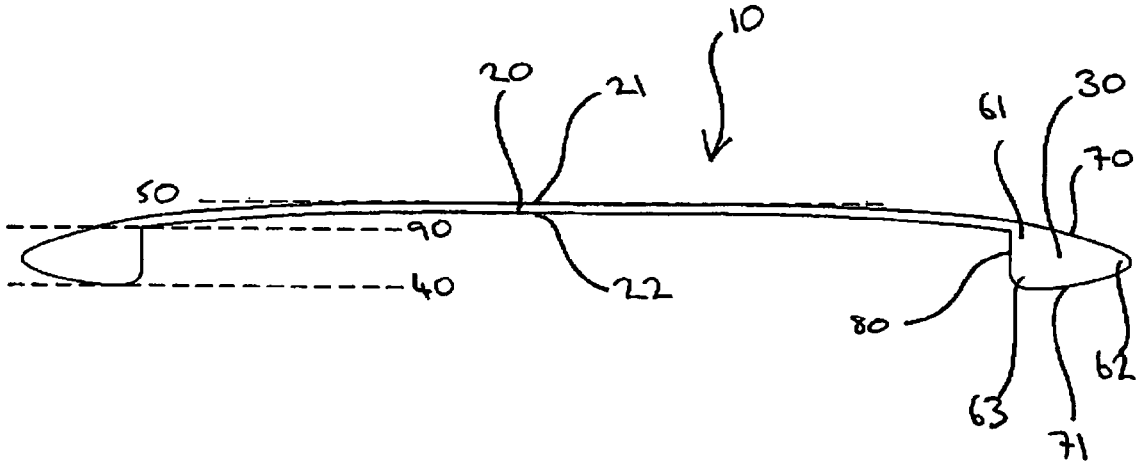
FIG. 1 shows a cross-section through the center of a disc (a circular planform wing).
Figure 2:
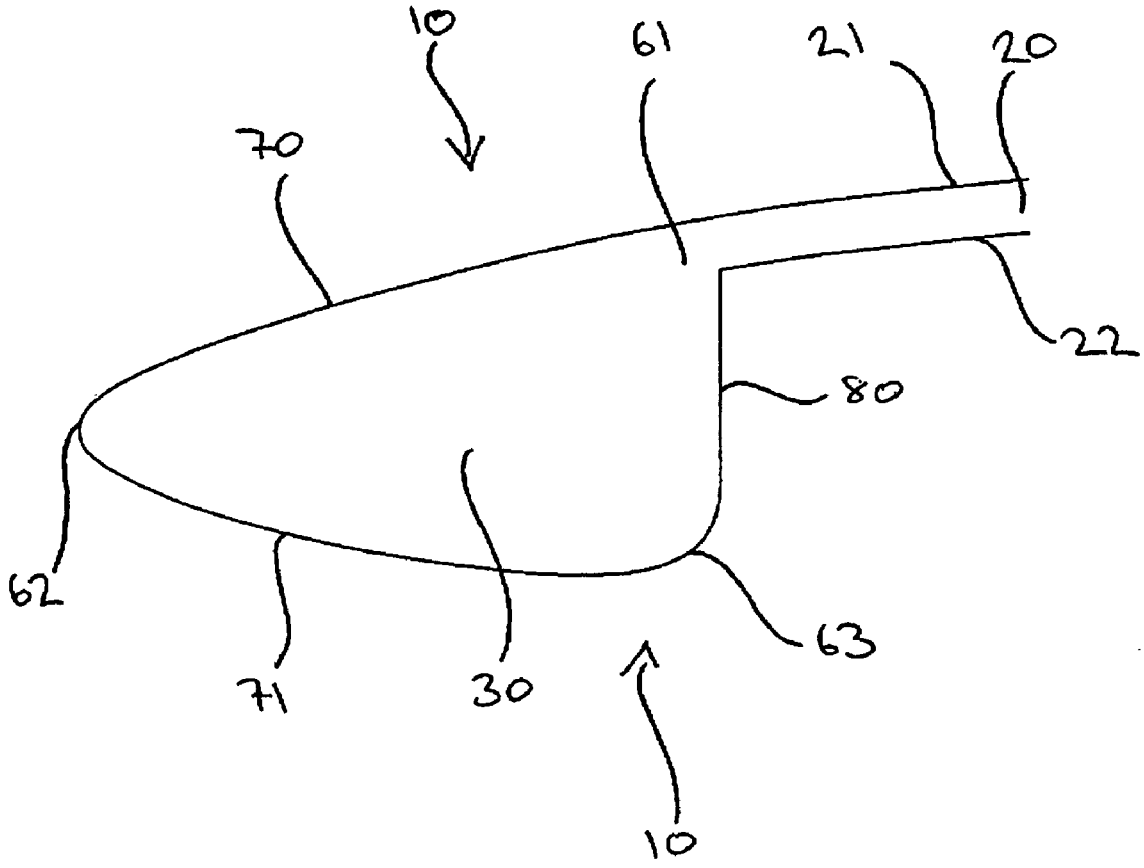
FIG. 2 shows an enlarged section of the disc of FIG. 1.

Disc 10 comprises a circular planform wing having central plate 20 having top surface 21 and bottom surface 22, and is encompassed by outer annular rim 30.

Rim 30 has an upper corner 61 which merges with central plate 20, an outer rounded corner 62 and a lower corner 63. The uppermost point of top surface 21 defines an upper zone of central plate 20 and an upper plane 50 of disc 10. The lower edge of rim 30 (i.e. the lower edge of lower corner 63) defines a lower plane 40 of disc 10. Between upper plane 50 and lower plane 40 is located outer rounded corner 62, which is radially outwards of upper corner 61 and lower corner 63.

A convex curve 70 joins upper corner 61 to outer rounded corner 62. Similarly, a convex curve 71 joins outer rounded corner 62 to lower corner 63.

Lower corner 63 comprises a section of an ellipse between a minor axis adjacent the lower edge of lower corner 63 (where it is at zero degrees to the horizontal) and a major axis which is located away from lower corner 63 and towards inside rim 80 and upper corner 61. Thus a convex lower lip is defined, with the lip surface following an approximate quarter ellipse profile, curving gently from the horizontal (at lower plane 40) to vertical, with its radius of curvature decreasing and merging with inside rim 80.

The advantages of the shape of disc 10 are discussed above.

Thus a cross-section through rim 30 extending radially from the center of disc 10 can be considered to have a generally triangular shape, although the shape of corners 61, 62, 63 and the convex curves joining outer rounded corner 62 to upper corner 61 and lower corner 63 means that the shape per se is not triangular.

Figure 3:
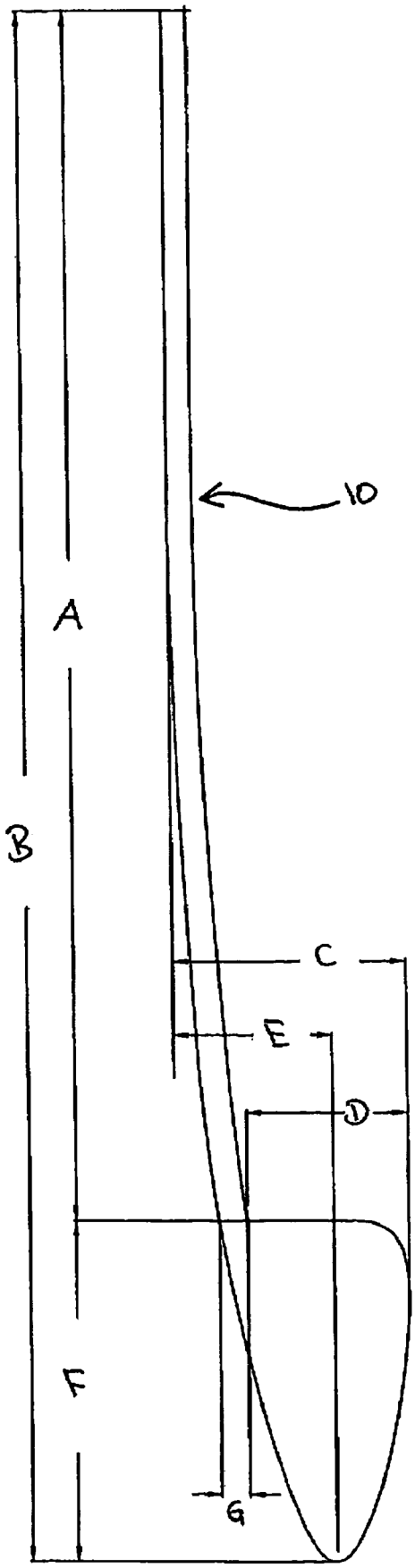
FIG. 3 shows the linear dimensions of the disc of FIG. 1.

Disc 10 has the following linear dimensions: inside rim 80 has a diameter of 164.8236 mm (radius A is shown in FIG. 3). The diameter of outer rounded corner 62 is 211.2460 mm (radius B is shown in FIG. 3). The height C of disc 10 from lower plane 40 to upper plane 50 is 15.9607 mm, upper plane 50 extending upwardly from upper corner 61 due to curvature of central plate 20. Measuring from the plane 90 (at which bottom surface 22 of central plate 20 intersects rim 30—the "rim intersection plane") to lower plane 40, rim 30 has a height D of 10.9707.

The vertical distance E from upper plane 50 to the outer radius of disc 10 is 10.9398 mm, i.e. 5.0209 mm above lower plane 40. Therefore the outer radius of disc 10 (i.e. the radially outermost point of outer rounded corner 62) is 31.46% of the distance from lower plane 40 to upper plane 50, and is 45.77% of the distance from lower plane 40 to rim intersection plane 90.

The rim depth F (radial width) of rim 30 (measured from inside rim 80 to the outer radius of disc 10, i.e. outer rounded corner 62) is 23.2112 mm.

Rim 30 has a configuration rating (as defined by the PDGA Technical Standards) of 31.25. The rim configuration rating is determined by holding the rim of a disc perpendicular to a contour gauge having 13 probes per centimeter (an example is the Valued ST142 Contour Gauge). The rim of the disc is then pressed into the gauge to a depth of 5 mm and the displacement of each probe determined to the nearest 0.25 mm, and the values for all 13 probes summed to give the rim configuration rating.

Rim depth (calculated as the distance between a straight edge placed across both rims and the point where the rim meets the central plate) divided by inside rim diameter (calculated using a pair of inside calipers, equal to the outside disc diameter minus twice the rim thickness; rim thickness is determined using a vernier caliper and equals the distance between the outermost and innermost edges of the rim; outside disc diameter is determined using a pair of calipers with a 40 cm measuring capacity, and is the average of measurements made at two transects at right angles to one another across the long axis of the disc) should generally give a value of at least 0.05, and in the case of this embodiment gives a value of 0.052.

Central plate 20 has a constant thickness G of 1.9707 mm. Disc 10 is fabricated from low density polyethylene, giving it a weight of between 164 and 175 grams.

In a second embodiment, corners and curves 62A, 63A, 70A and 71A of rim 30A of disc 10A are defined by reference to the arcs of circles. Linear dimensions are as for disc 10 (above).

With the center of the top surface 21A having the (x, y) coordinates in millimeters (0, 0), curves and corners 71A, 63A, 62A and 70A are defined as follows:

1. Convex curve 71A is an arc of a circle having its center at the coordinates (64.7933, −109.354) and a diameter of 85.5117 mm.

2. Lower corner 63A is an arc of a circle having its center at the coordinates (85.1931, −12.8839) and a diameter of 5.5208 mm, extending from a point at which it is at zero degrees to the vertical.

3. Outer corner 62A is as arc of a circle having its center at the coordinates (104.4479, −10.9007) and a diameter of 2.3387 mm.

4. Convex curve 70A is an arc of a circle having its center at the coordinates (87.4904, 26.8533) and a diameter of 215.5663 mm.

Figure 4:
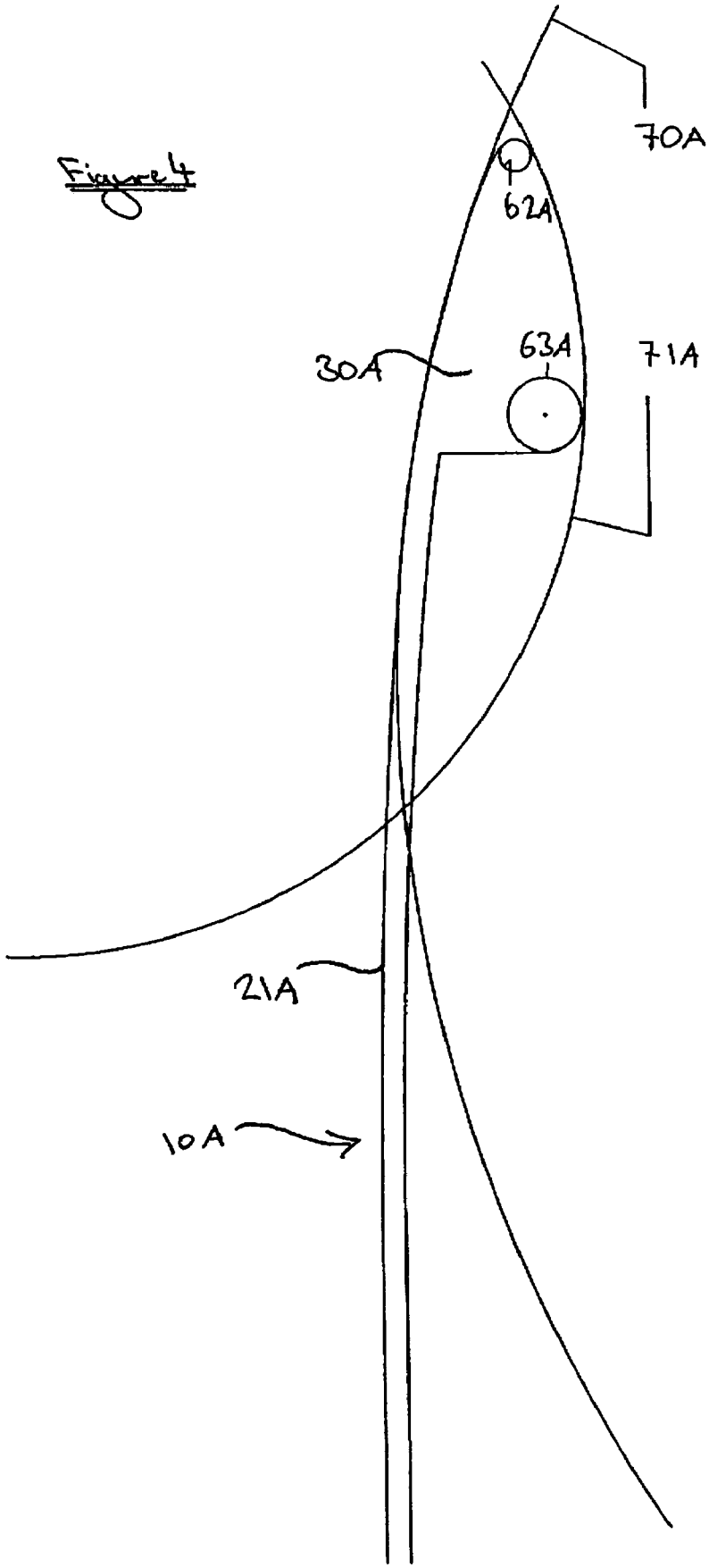
FIG. 4 shows a cross-section through a second disc, corners and curves 62A, 63A, 70A and 71A being defined with reference to arcs of circles.
Figure 6:
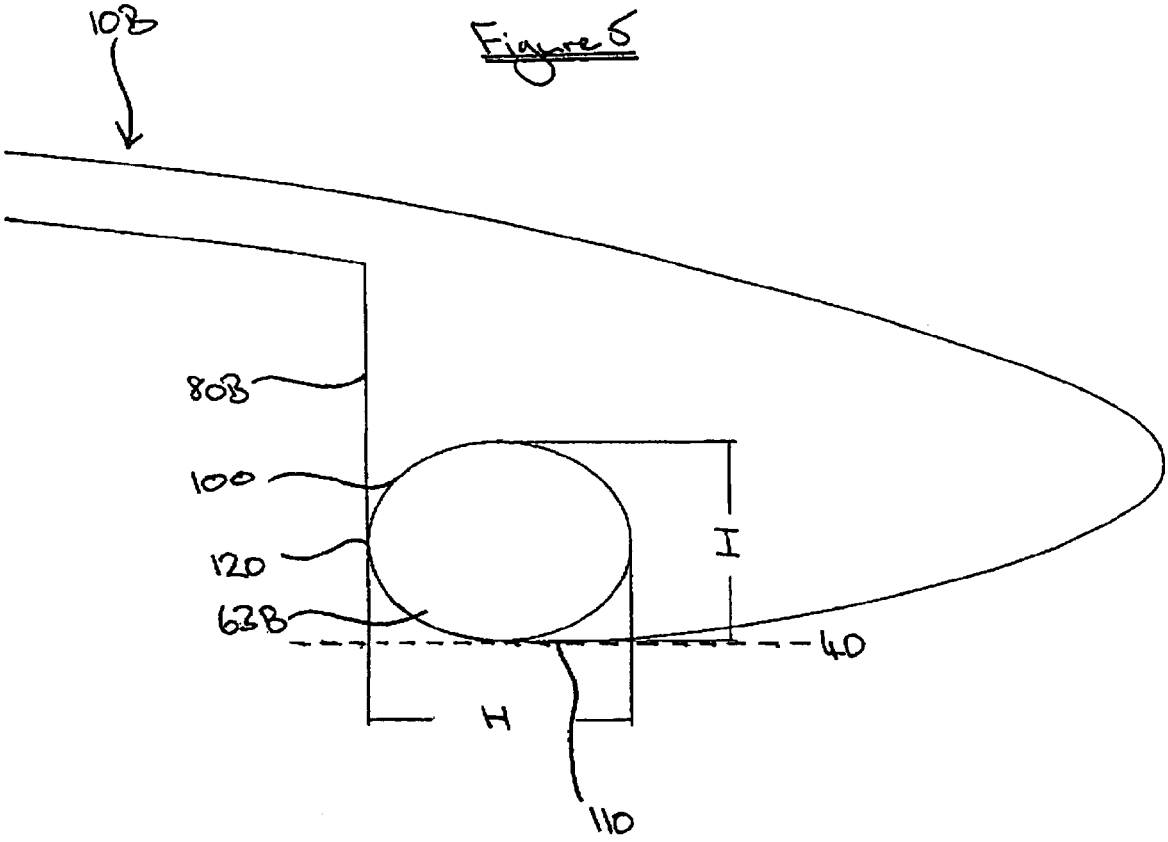

The four arcs are joined by appropriate curved sections so as to provide a continuously convex surface and a smooth curve from one arc to the next, as shown in FIG. 4.

In a third embodiment, disc 10B has lower corner 63B defined substantially by a section of an ellipse 100 having its center at the coordinates (86.2432, −13.0245), a major axis H having a length of 7.5889 mm and a minor axis I having a length I of 5.7519 mm. Coordinates are relative to the center of the top surface which has the (x, y) coordinates in millimeters (0, 0).

As is seen in FIG. 5, plane 40 is below ellipse 100 and so only a section of lower corner 63B from the first point 110 (defining lower plane 40) to a second point 120 where lower corner 63B has an angle of zero degrees to the vertical and merges with inside rim 80B is a section of ellipse 100. Overall, the radius of curvature decreases from first point 110 to second point 120.

Each of discs 10, 10A and 10B has enhanced characteristics with regard to the prior art circular planform wings (discs)

Any reference to disc characteristics which is not defined herein is defined in the PDGA (Professional Disc Golf Association) Technical Standards documentation.

It will be appreciated that it is not intended to limit the invention to the above example only, many variations, such as might readily occur to one skilled in the art, being possible, without departing from the scope thereof as defined by the appended claims.

The invention claimed is:

1. A circular planform wing having a structure comprising:

a contiguous thin central plate having top and bottom surfaces;

an outer annular rim encompassing the central plate;

the rim having a lower edge defining a lower plane of the wing, and the central plate having an upper zone defining an upper plane of the wing;

the rim having a cross-section with a lower corner forming the lower edge, an outer rounded corner, and an upper corner merging with the central plate, the outer corner being located between the upper plane and the lower plane; and the rim cross-section having a convex upper curve joining the outer rounded corner to the upper corner, the rim cross-section having an inside rim surface joining the lower corner to the upper corner, and the lower corner comprising a lower curve from a first point comprising the lower edge of the rim to a second point where the lower corner merges with the inside rim surface, the radius of curvature of the lower curve decreasing from the first point to the second point.

2. The circular planform wing of claim 1, wherein the lower curve from the first point to the second point is a section of an ellipse between a minor axis adjacent the lower edge and a major axis.

3. The circular planform wing of claim 1, wherein the rim cross-section has a convex outer curve joining the outer rounded corner to the lower corner.

4. The circular planform wing of claim 3, wherein the upper curve of the rim cross-section is continuous, and the outer curve is continuous.

5. The circular planform wing of claim 1, wherein a radially outermost point of the outer rounded corner is vertically located 25-65% of a distance from the lower plane to a rim intersection plane at which the central plate bottom surface intersects the inside rim.

6. The circular planform wing of claim 5, wherein the radially outermost point of the outer rounded corner is vertically located at one of the group consisting of: 30-60%, 35-55%, 40-50%, and about 45% of the distance from the lower plane to the rim intersection plane.

7. The circular planform wing of claim 1, wherein a radially outermost point of the outer rounded corner is vertically located 25-40% of a distance from the lower plane to the upper plane.

8. The circular planform wing of claim 7, wherein the radially outermost point of the outer rounded corner is vertically located at one of the group consisting of: 27.5% -37.5%, 30-35%, and about 31.5% of the distance from the lower plane to the upper plane.

9. The circular planform wing of claim 1, wherein the inside rim surface is substantially vertical.

10. The circular planform wing of claim 1, wherein the lower edge of the rim cross-section is at an angle of zero degrees to the horizontal.

11. The circular planform wing of claim 1, wherein the wing is a flying disc.

12. The circular planform wing of claim 10, wherein the flying disc comprises a single piece of material.

13. The circular planform wing of claim 1, wherein the wing is axi-symmetric about the center of the central plate.

14. A circular planform wing having a structure comprising:

a contiguous thin central plate having top and bottom surfaces;

an outer annular rim encompassing the central plate;

the rim having a lower edge defining a lower plane of the wing, and the central plate having an upper zone defining an upper plane of the wing;

the rim having a cross-section with a lower rounded corner forming the lower edge, an outer rounded corner, and an upper corner merging with the central plate, the outer corner being located between the upper plane and the lower plane; and the rim cross-section having a convex upper curve joining the outer rounded corner to the upper corner, an inside rim surface joining the lower rounded corner to the upper corner, and a convex lower curve joining the outer rounded corner to the lower rounded corner.

15. The circular planform wing of claim 14, wherein the upper curve is continuous, and the lower curve is continuous.

16. The circular planform wing of claim 14, wherein a radially outermost point of the outer rounded corner is vertically located 25-65% of a distance from the lower plane to a rim intersection plane at which the central plate bottom surface intersects the inside rim.

17. The circular planform wing of claim 16, wherein the radially outermost point of the outer rounded corner is vertically located at one of the group consisting of: 30-60%, 35-55%, 40-50%, and about 45% of the distance from the lower plane to the rim intersection plane.

18. The circular planform wing of claim 14, wherein a radially outermost point of the outer rounded corner is vertically located 25-40% of a distance from the lower plane to the upper plane.

19. The circular planform wing of claim 18, wherein the radially outermost point of the outer rounded corner is vertically located at one of the group consisting of: 27.5%-37.5%, 30-35%, and about 31.5% of the distance from the lower plane to the upper plane.

20. The circular planform wing of claim 14, wherein the inside rim surface is substantially vertical.

21. The circular planform wing of claim 14, wherein the lower edge of the rim cross-section is at an angle of zero degrees to the horizontal.

22. The circular planform wing of claim 14, wherein the wing is a flying disc.

23. The circular planform wing of claim 22, wherein the flying disc comprises a single piece of material.

24. The circular planform wing of claim 14, wherein the wing is axi-symmetric about the center of the central plate.

* * * * *